US010231515B2

(12) United States Patent
Truelsen et al.

(10) Patent No.: US 10,231,515 B2
(45) Date of Patent: Mar. 19, 2019

(54) CUP-SHAPED SHANK FOR HEELED SHOES

(71) Applicant: ECCO Sko A/S, Bredebro (DK)

(72) Inventors: Ejnar Truelsen, Tonder (DK); Frank Jensen, Bredebro (DK); Hans Christian Hansen, Løgumkloster (DK); Niki Taestensen, Flensborg (DK)

(73) Assignee: ECCO Sko A/S, Bredebro (DK)

( * ) Notice: Subject to any disclaimer, the term of this patent is extended or adjusted under 35 U.S.C. 154(b) by 0 days.

(21) Appl. No.: 15/068,781

(22) Filed: Mar. 14, 2016

(65) Prior Publication Data

US 2016/0360834 A1 Dec. 15, 2016

(30) Foreign Application Priority Data

Mar. 16, 2015 (EP) ..... 15159200

(51) Int. Cl.
*A43B 13/14* (2006.01)
*A43B 23/22* (2006.01)
(Continued)

(52) U.S. Cl.
CPC ..... *A43B 23/222* (2013.01); *A43B 13/141* (2013.01); *A43B 13/37* (2013.01); *A43B 21/38* (2013.01); *A43B 21/46* (2013.01)

(58) Field of Classification Search
CPC ..... A43B 23/22; A43B 23/222; A43B 23/225; A43B 23/227; A43B 13/37; A43B 13/41
See application file for complete search history.

(56) References Cited

U.S. PATENT DOCUMENTS 1,597,886 A * 8/1926 Hawthcrne ..... A43B 23/22 36/76 R
1,847,287 A * 3/1932 White ..... A43B 23/22 36/18
(Continued)

FOREIGN PATENT DOCUMENTS

DE 2949149 A1 6/1980
FR 1211345 3/1960
(Continued)

OTHER PUBLICATIONS

European Search Report for corresponding application EP 15 15 9200; Report dated Aug. 27, 2015.

*Primary Examiner* — Ted Kavanaugh
(74) *Attorney, Agent, or Firm* — Finnegan, Henderson, Farabow, Garrett & Dunner, LLP

(57) ABSTRACT

The present invention relates to a shank adapted for being integrated into a shoe sole and for mounting a heel element, wherein said shank at its heel portion is adapted to be connected to the heel element and wherein said shank comprises an upper surface pointing towards the inner shoe. At least a part of the upper surface at the heel portion is cup-shaped and adapted for receiving sole material inside the cup when integrating said shank in said sole during molding of said shoe sole. Thereby, due to the amount of sole material present in the heel portion, the sole material covers the means used for connecting the shank to the heel element. Thereby, based on the properties of the sole material, the heeled shoe becomes comfortable and flexible at the heel portion. The invention further relates to a sole for a shoe with a cup-shaped shank and more specifically to a shoe with a cup-shaped shank.

13 Claims, 3 Drawing Sheets

(51) Int. Cl.

| | |
|---|---|
| ***A43B 13/37*** | (2006.01) |
| ***A43B 21/38*** | (2006.01) |
| ***A43B 21/46*** | (2006.01) |

(56) References Cited

U.S. PATENT DOCUMENTS

| | | | | | |
|---|---|---|---|---|---|
| 1,895,660 | A | * | 1/1933 | Hauck | A43B 23/22 36/76 R |
| 2,099,394 | A | * | 11/1937 | Gordon | A43B 23/22 36/76 R |
| 2,171,719 | A | * | 9/1939 | Whelton | A43B 7/144 12/146 BP |
| 2,263,187 | A | * | 11/1941 | Parkhurst | A43B 23/22 36/24.5 |
| 4,439,937 | A | * | 4/1984 | Daswick | A43B 13/10 36/107 |
| 5,416,989 | A | | 5/1995 | Preston | |
| 5,720,117 | A | * | 2/1998 | Toschi | A43B 23/22 36/169 |
| 5,722,186 | A | * | 3/1998 | Brown | A43B 1/0054 36/140 |
| 2006/0277795 | A1 | * | 12/2006 | Baier | A43B 13/12 36/30 R |
| 2011/0030245 | A1 | * | 2/2011 | Truelsen | A43B 5/06 36/30 R |
| 2015/0052777 | A1 | | 2/2015 | Jennings | |

FOREIGN PATENT DOCUMENTS

| | | | |
|---|---|---|---|
| GB | 1003951 | A | 9/1965 |
| GB | 2053073 | A | 2/1981 |
| WO | 2005096860 | A1 | 10/2005 |
| WO | 2013041105 | A | 3/2013 |

* cited by examiner

CUP-SHAPED SHANK FOR HEELED SHOES

CROSS REFERENCE TO RELATED APPLICATION

This application is related to and claims the benefit of European Patent Application Number 15159200.3, filed on 16 Mar. 2015, the contents of which are herein incorporated by reference in their entirety.

FIELD OF THE INVENTION

The present invention relates to a cup-shaped shank for a heeled shoe. The invention further relates to a sole for a heeled shoe with a cup-shaped shank and more specifically to a heeled shoe with a cup-shaped shank.

BACKGROUND

An important aspect when wearing shoes is that the shoe should be comfortable to wear. Elements that can increase the comfort of wearing a shoe includes flexibility of the shoe sole and another aspect may be the softness of the surface inside the shoe having contact with the surface of the foot wearing the shoe.

Normally, the comfort of a shoe is optimized by having specific properties of the sole material, but sometimes a specific sole material needs to be used due to design requirements or the type of shoe or due to the type of shoe determining specific design elements.

BRIEF SUMMARY

In accordance with the invention, a shank is provided adapted for being integrated into a shoe sole and for mounting a heel element, wherein said shank at its heel portion is adapted to be connected to the heel element and wherein said shank comprises an upper surface pointing towards the inner shoe. At least a part of the upper surface at the heel portion is cup-shaped and adapted for receiving sole material inside the cup when integrating said shank in said sole during molding of said shoe sole.

Thereby, due to the amount of sole material present in the heel portion, the means used for connecting the shank to the heel element are covered by the sole material.

Thereby, based on the properties of the sole material, the heeled shoe becomes comfortable and flexible at the heel portion. Further, the cup shape ensures that the flexibility increases towards a center axis of the cup shape since more sole material is present at the center, typically above the aperture and the fastening means. Typically, and especially regarding high-heeled footwear, the contact point between foot and shoe at the heel can be uncomfortable. By having a cup shape at the heel, a much more flexible surface can be obtained, whereby the high-heeled shoe is more comfortable to wear.

The connection between shank and heel element maybe via e.g. screws or nails inserted through the shank towards the heel element. Other fastening means such as glue may also be used.

In an embodiment, the shank comprises a heel portion and a front portion and wherein the shank is shaped to extend from the heel via the heel portion towards the front of a shoe and wherein the cup shape at the heel portion decreases towards the front portion. Thereby, after molding, more sole material is present at the upper part at the heel portion than at the front portion, which ensures that flexibility gradually decreases along the middle portion towards the front portion.

In an embodiment, the entire upper surface of the shank is cup-shaped. Thereby, the entire inner surface is more comfortable.

In an embodiment, the shank at its heel portion comprises an aperture for inserting fastening means for obtaining a connection to the heel element. Thereby, due to the amount of sole material present in the heel portion, sole material covers the aperture as well as the top of the fastening means.

The fastening means may be e.g. a screw or bolt and they can be inserted for connecting a heel element to the cup-shaped shank.

In an embodiment, the aperture is shaped for receiving said fastening means, whereby the fastening means are below the upper surface of the shank when mounted. Thereby, it is ensured that the fastening means do not reduce the comfort of the shoe.

In an embodiment, the shank is shaped for following the contour of a foot wearing a heeled shoe and wherein when the front portion of the shank rests on a surface, the shank part behind the front portion are inclined upwards and away from said surface ending at the heel portion of the shank. Thereby, space is obtained below the heel portion, whereby a heel element can be mounted and a shoe can be made following the shape of the foot when wearing the heeled shoe.

In an embodiment the shank has multiple holes through which sole material can flow when molding said shoe sole. Thereby, the molding process becomes faster.

In an embodiment, said multiple holes comprise a row of holes extending from the heel portion towards the front portion positioned along a central axis of the shank.

In an alternative, multiple holes are positioned along the edge of the shank at the heel portion extending towards the front portion.

By specific positioning of the holes according to the above, it can be ensured that the flow of sole material can be controlled in an optimal manner.

The invention further relates to a sole for a shoe with a cup-shaped shank and more specifically to a shoe with a cup-shaped shank.

BRIEF DESCRIPTION OF DRAWINGS

The invention is explained in detail below with reference to the drawings, in which.

DETAILED DESCRIPTION OF DRAWINGS

Figure 1A:
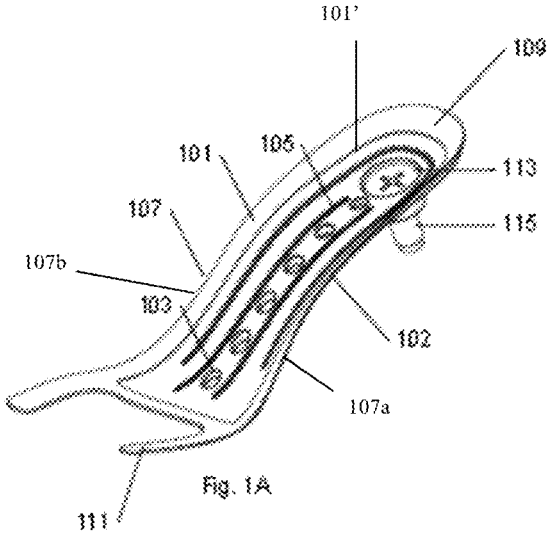
FIG. 1A illustrates an embodiment of a cup-shaped shank according to the present invention.
Figure 1B:
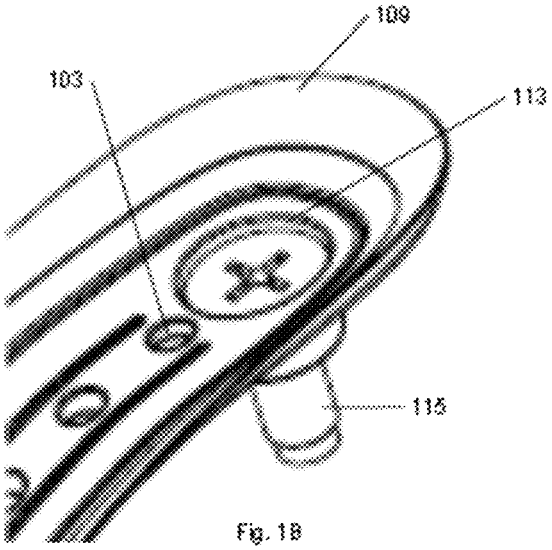
FIG. 1B illustrates an enlarged partial view of the shank of FIG. 1A.

FIG. 1B illustrates an embodiment of a cup-shaped shank according to the present invention and FIG. 1B is a zoom on the heel portion of the shank illustrated in FIG. 1A. The cup-shaped shank is for integrating in a sole when molding the shoe and by adding the cup-shaped shank to the sole, specific shapes as well as stiffness can be added to the sole material. Producing a shoe with a cup-shaped shank according to the present invention, may be done by positioning the cup-shaped shank in a mold, and then injecting the sole material into the mold to shape the sole. Materiel is injected to be present on both sides of the cup-shaped shank and thereby the cup-shaped shank is completely integrated in the sole material after hardening.

As can be seen from FIGS. 1A and 1B, the cup-shaped shank according to the present invention comprises an upper surface 101 and an opposite lower surface 102. At the upper surface 101, the shank has a cup shape, which is mainly at the heel portion 109, whereby more flexible sole material can be present at a central part 105 of the upper surface 101 of the cup-shaped shank compared to at an edge 107 of the cup-shaped shank. Less flexible material may be present at the edge 107 to maintain stiff edges, whereby the inner sole surface of the shoe for contacting the foot has a softness, which gradually increases from the medial and lateral edges 107*a* and 107*b*, respectively, towards the center part 105.

In FIGS. 1A and 1B, the upper surface 101 of the shank is cup-shaped at the heel portion and the cup gradually decreases from the heel portion 109 towards the front portion 111 of the shank to create a volume 101'. Thereby, a larger amount of flexible sole material can be present at the heel portion 109, which again results in more softness and a more flexible contact point between the heel portion of the shoe and the heel of a foot. The volume receives sole material inside the cup when integrating said shank in said sole during molding of said shoe sole.

In another embodiment of a cup-shaped shank according to the present invention, it may be only the heel portion of the shank that is cup-shaped. In yet another embodiment, the shank of the present invention is only a cup-shaped heel shank and solely for obtaining specific properties of the heel portion of a sole. In such an embodiment, the cup-shaped shank may be the only shank in the sole, but alternatively another shank supplementing the cup-shaped shank may be used for the sole.

From FIGS. 1A and 1B it can be seen that the cup-shaped shank comprises a number of holes 103, whereby injected sole material can float/flow through the cup-shaped shank e.g. from the lower surface 102 to the upper surface 101. Thereby, it becomes easier to ensure that injected materiel is present on both lower surface 102 and the upper surface 101 of the cup-shaped shank and that the cup-shaped shank is completely integrated into the sole.

The multiple holes may extend from the heel portion towards the front portion positioned along a central axis of the shank and there may further be holes positioned along the edge of the shank at the heel portion 109, which extends towards the front portion 111.

In FIGS. 1A and 1B, aside from the cup-shaped upper surface 101, the cup-shaped shank is also shaped with a curved side profile according to the sole design of a heeled shoe. Thereby, when the front portion 111 of the sole rests on a surface, a heel element (not shown) can be positioned to support the heel portion 109 of the sole. In one embodiment, the cup-shaped shank used for such a sole may be shaped similarly, whereby when the front portion of the shank rests on a surface, the shank part behind the front portion is inclined upwards and away from the surface ending at the heel portion of the shank. The curvature of the side profile depends on the design of the shoe and more specifically on the height of the heel elements.

In FIGS. 1A and 1B, the shank 101 at its heel portion 109 comprises an aperture 113 for inserting fastening means 115 for obtaining a connection between a heel element (not shown). Further, it can be seen how the top level of the fastening means 115 is lowered in the aperture at a level lower than the upper surface of the shank. Fastening means 115 may be e.g. a bolt or a screw for interacting with the corresponding hole in the heel element (not shown).

The aperture may be shaped in such a manner that when inserting the fastening means, such as a screw or bolt, the top surface of the head of the screw or bolt is below the upper surface of the cup-shaped shank. Further, the aperture may be shaped according to the shape of the head of the screw or bolt to further ensure a good contact between the fastening means and the cup-shaped shank. In an embodiment, the edge of the hole may be corrugated to interact with the screw or bolt and lock the screw or bolt to the heel element when fastened, minimizing the risk of the heel element becoming loose during use of the shoe.

In one embodiment, a heel element is connected to the cup-shaped shank before injecting sole material, and sole material is injected to cover both the heel element as well as the cup-shaped shank. Alternatively, the sole material is injected around the cup-shaped shank and afterwards a heel element is mounted via fastening means. This may in one embodiment be via a screw or bolt through an aperture in the cup-shaped shank or it may be by using other fastening means such as nails or glue.

Figure 2A:
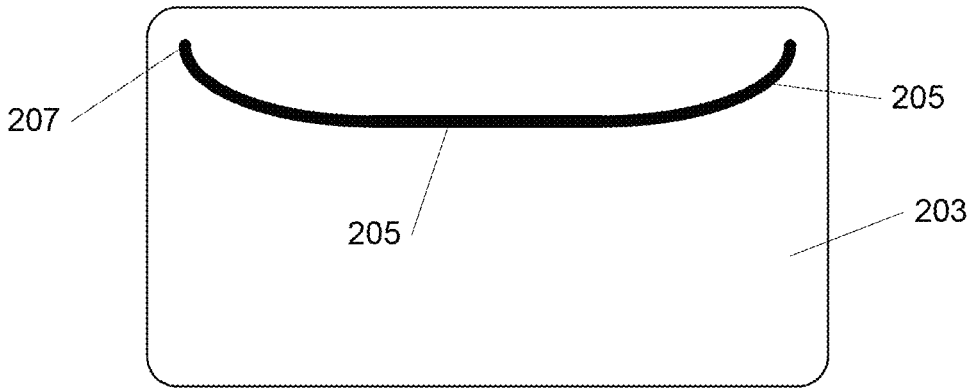
FIG. 2A illustrates a transverse cut through a heel of a sole comprising a cup-shaped shank.

FIG. 2A illustrates a transverse cut through the heel of a sole comprising a cup-shaped shank, the cup-shaped shank being integrated in the sole material 203. It can be seen how more sole material is present at the center 205 than at the edge 207. The curve of the cup shape can be chosen to obtain optimal properties of the sole with the integrated cup-shaped shank.

Figure 2B:
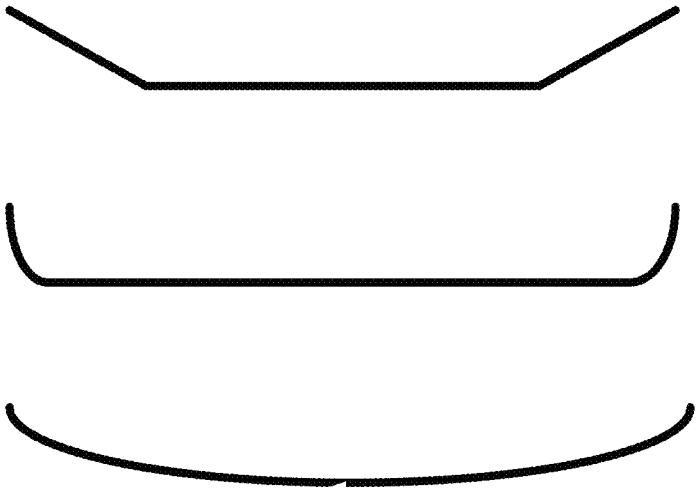
FIG. 2B illustrates alternative curvatures of the cup shape.

FIG. 2B illustrates different curvatures of the cup shape, which can be chosen depending on the properties to be obtained in the shoe.

Figure 3:
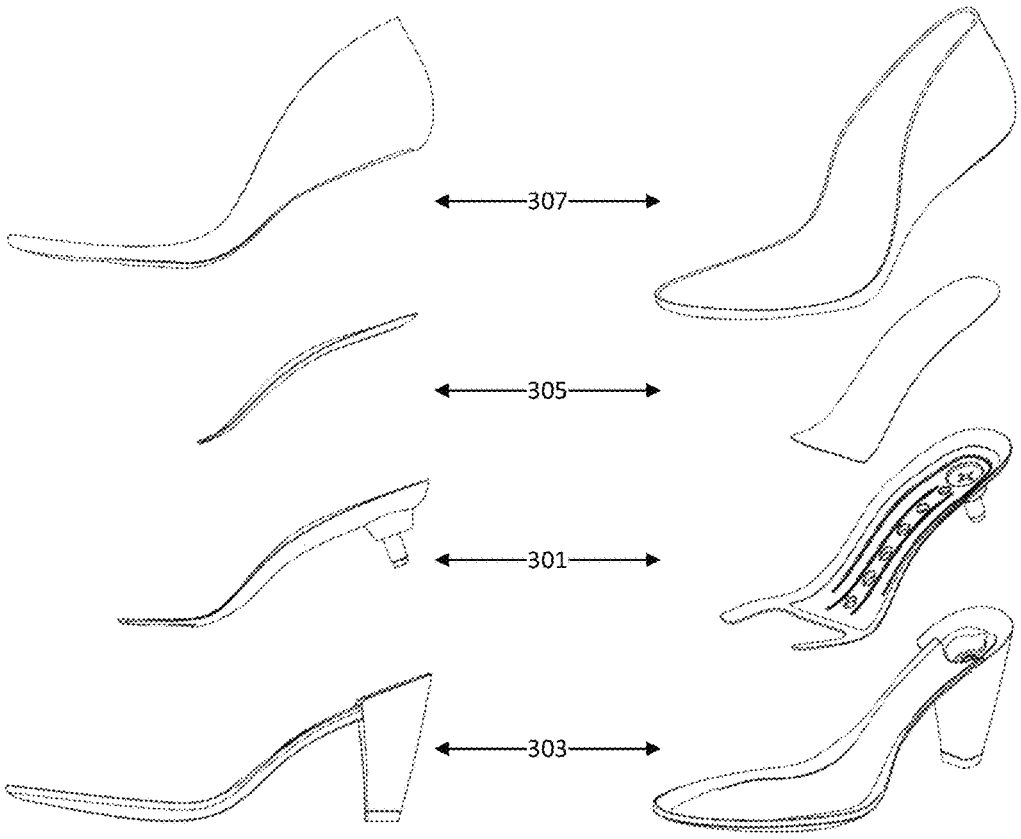
FIG. 3 illustrates an exploded view of a shoe with a heel from both the side and front.

FIG. 3 illustrates the element of a shoe with a heel from both the side and front. The embodiment of the shank 301 according to the present invention is connected to the heel element 303 via the fastening means through an aperture in the shank 301. Further, the shoe comprises a sole 305 and an upper 307.

The invention claimed is:

1. A shank adapted for being integrated into a molded shoe sole and for mounting a heel element, said shank comprising:

a front portion a heel portion comprising a lower surface configured to be connected to the heel element; and an upper surface configured to face a foot of a user during use, wherein the upper surface comprises a heel end, a medial peripheral edge, and a lateral peripheral edge;

wherein the upper surface further comprises a central portion, positioned between the medial peripheral edge and the lateral peripheral edge;

wherein the medial peripheral edge and the lateral peripheral edge are positioned higher than the central portion, seen in cross section, such that the upper surface delimits a volume configured to receive a sole material inside the volume when integrating said shank in said sole during a molding of said shoe sole;

wherein the medial peripheral edge and the lateral peripheral edge reduce in height relative to the central portion in a direction towards the front portion of the shank;

wherein the volume delimits a heel cup at the heel portion;

wherein the shank further comprises a fastening assembly configured to secure the shank to a heel element;

wherein the fastening assembly comprises a fastening member and an aperture formed in the heel portion of the shank, the aperture configured to receive the fastening member; and wherein the aperture is positioned in a lowest part of the heel cup.

2. A shank according to claim 1, wherein said shank at the heel portion comprises said aperture for inserting fastening member for obtaining a connection to the heel element.

3. A shank according to claim 2, wherein said aperture is shaped for receiving said fastening member, whereby the fastening member is below the upper surface of the shank when mounted.

4. A shank according to claim 1, wherein a shape of the shank is configured to follow a contour of a foot wearing a heeled shoe and wherein the shank inclines upwards and away from said front portion ending at the heel portion of the shank when the front portion of the shank rests on a ground surface.

5. A shank according to claim 1, wherein said shank has multiple holes through which sole material can flow when molding said shoe sole.

6. A shank according to claim 5, wherein said multiple holes comprise a row of holes extending from the heel portion towards the front portion positioned along a central axis of the shank.

7. A shank according to claim 5, wherein said multiple holes comprise holes positioned along an edge of the shank at the heel portion and, said holes extending towards the front portion.

8. A sole for a shoe comprising a shank according to claim 1.

9. A shoe comprising a shank according to claim 1.

10. A shank according to claim 1, wherein the fastening member comprises a screw or a bolt.

11. A shank according to claim 10, wherein a top surface of the screw or bolt is disposed below the upper surface.

12. A shank according to claim 1, wherein a shape of the aperture corresponds to a shape of a head of the fastening member.

13. A shank according to claim 1, wherein a peripheral edge of the aperture includes a corrugation configured to interact with the fastening member and to increase friction therebetween.

* * * * *